US005392754A

United States Patent [19]

Hopper et al.

[11] Patent Number: 5,392,754

[45] Date of Patent: Feb. 28, 1995

[54] METHOD OF SUPPRESSING RINGING IN AN IGNITION CIRCUIT

[75] Inventors: Daniel H. Hopper, Peru; Mark A. Laubenstein, Windfall; Marc R. Engelhardt, Kokomo, all of Ind.

[73] Assignee: Delco Electronics Corp., Kokomo, Ind.

[21] Appl. No.: 167,293

[22] Filed: Dec. 16, 1993

[51] Int. Cl.[6] ..... F02P 9/00

[52] U.S. Cl. ..... 123/609

[58] Field of Search ..... 123/609, 414, 422, 644, 123/606, 618, 406; 364/431.04, 431.08, 431.01, 431.03

[56] References Cited

U.S. PATENT DOCUMENTS

| | | | |
|---|---|---|---|
| 4,291,661 | 9/1981 | Gerry | 123/606 |
| 4,913,123 | 4/1990 | De Beiasi et al. | 123/609 |
| 4,915,086 | 4/1990 | Ciliberto et al. | 123/609 |
| 4,933,861 | 6/1990 | Allen et al. | 364/431.04 |
| 4,972,818 | 11/1990 | Nomura et al. | 123/414 |
| 4,977,883 | 12/1990 | Koiwa | 123/644 |
| 5,007,397 | 4/1991 | Akasu | 123/422 |
| 5,043,900 | 8/1991 | Allen et al. | 364/431.04 |

*Primary Examiner*—Raymond A. Nelli
*Attorney, Agent, or Firm*—Mark A. Navarre

[57] ABSTRACT

An inductive ignition circuit, comprising a secondary winding across a spark plug and a primary winding in series with a lossy transistor switch and a power source, is subject to ringing at the start of the dwell period which can cause premature combustion. Ringing is suppressed by a short switch turn on pulse followed by a short delay prior to the main dwell period, causing a beginning build up of primary current and circuit energy followed by absorption of energy in the switch during switching to dissipate circuit energy needed for oscillation. Preferably, the short pulse is terminated when all the ringing energy is stored in the leakage inductance of the ignition coil.

17 Claims, 2 Drawing Sheets

FIG - 1
PRIOR ART
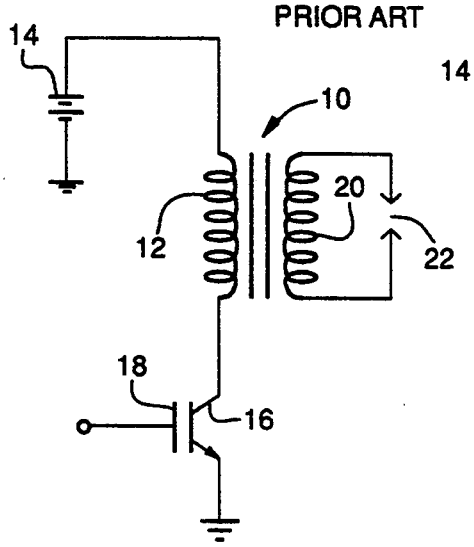
FIG - 2
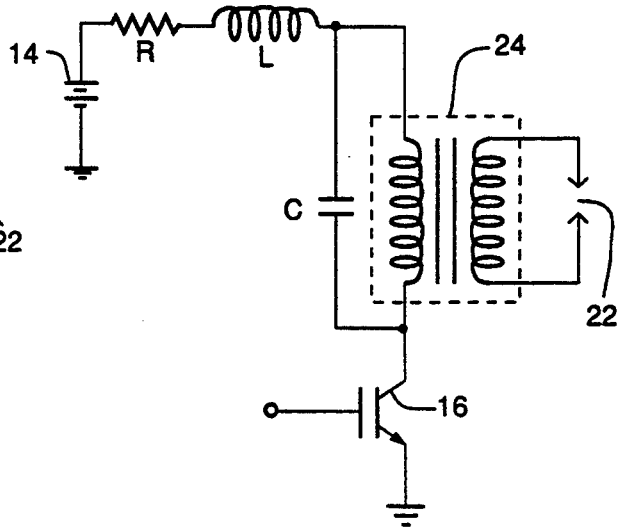
FIG - 3B
FIG - 3A
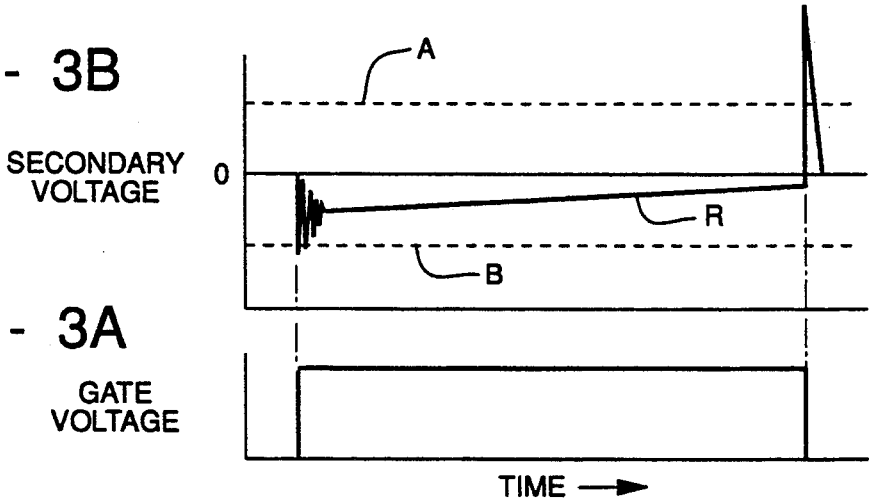
FIG - 5A
FIG - 5B
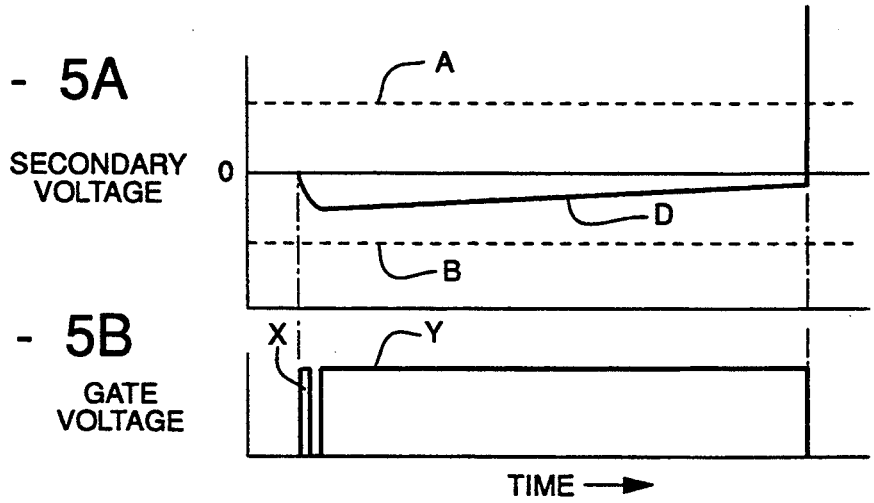

METHOD OF SUPPRESSING RINGING IN AN IGNITION CIRCUIT

FIELD OF THE INVENTION

This invention relates to a method of controlling an ignition circuit for an internal combustion engine and particularly to such a method for preventing ringing sufficient to prematurely fire a spark plug.

BACKGROUND OF THE INVENTION

Modern automotive engines rely on inductive ignition systems to fire the spark plugs. These comprise a coil having a secondary winding connected to a spark plug and a primary winding and a transistor switch serially connected across a voltage source. In operation, the switch is closed for a dwell period allowing current flow in the primary side to store energy in the coil, and when the switch is opened at the end of the dwell period the primary current is abruptly stopped and the secondary voltage becomes large enough to fire the spark plug, thereby discharging the stored energy into the plug gap. An undesirable side effect of the operation is that upon initial closing of the switch a high voltage, in the opposite sense, is developed in the secondary and typically is accompanied by oscillations or ringing of such magnitude that premature firing of the plug can occur, sometimes causing combustion in the corresponding cylinder. This phenomenon is called "ignition on make."

Ignition systems employing a distributor do not exhibit ignition on make because the additional gap provided by the rotor increases the required secondary voltage to a value higher than that due to the initial ringing. Similarly, distributorless ignition systems which have one coil shared by two cylinders also have an additional gap because there are two spark plugs in series and the premature firing does not occur. The ignition on make problem does appear, however, for ignition systems having one coil per cylinder; there the single plug gap can discharge at the beginning of the dwell period causing premature combustion.

One proposed solution to the ignition on make problem is to insert a high voltage blocking diode in the secondary circuit in series with the spark plug and coil to block the negative voltage produced at switch closing. Such diodes are expensive and potentially unreliable. Another solution is to slowly ramp on the transistor switch to reduce secondary ringing, but the dwell time delivered will not equal the dwell time commanded. The ramp introduces a delay which varies with temperature, battery voltage, and process variations.

SUMMARY OF THE INVENTION

It is therefore an object of the invention to reduce or eliminate high voltage oscillation upon initiating the dwell without variance in the dwell period. Another object is to manage the ignition make event to begin the dwell period without generating significant ringing.

To carry out the invention, the oscillation of the ignition circuit is damped by absorbing the energy build-up necessary for oscillation. This is carried out without any change in the basic ignition circuit but only in the method of controlling the switching. The transistor switch is controlled to absorb the stored energy due to initial primary current just after turn on. Ringing energy is stored in the leakage inductance of the ignition coil; optimally, the transistor switch is commanded to turn off just as all the ringing energy is stored in the leakage inductance.

The transistor switch control is effected by a signal from an electronic engine control unit or ignition module. Normally the spark control signal comprises a single square wave pulse which is delivered to the control electrode of the transistor switch to turn on the transistor prior to the desired spark time by the amount of the dwell period, the pulse lasting for the dwell period, and the spark occurs upon turn off of the transistor switch. The improvement occurs by switching on the dwell period such that absorption of energy takes place initially. By supplying the control signal as two pulses, one very short pulse followed quickly by the remainder of the dwell pulse the ringing phenomenon is abated. The short pulse is terminated even before the secondary voltage reaches its normal steady state value. Then the main pulse is commanded to finish the dwell function. During the off time between the two pulses or as a consequence of the switching action, the energy required for oscillation is absorbed by the transistor switch.

BRIEF DESCRIPTION OF THE DRAWINGS

The above and other advantages of the invention will become more apparent from the following description taken in conjunction with the accompanying drawings wherein like references refer to like parts and wherein:

FIG.1 is a schematic diagram of a conventional inductive ignition circuit used in the practice of the invention;

FIG. 2 is a diagram of an equivalent circuit for the conventional circuit of FIG. 1;

FIGS. 3*a* and 3*b* are diagrams of control voltage and secondary voltage, respectively, for the conventional operation of the circuit of FIG. 1;

FIG. 5*a* and 5*b* are diagrams of secondary voltage and control voltage, respectively, for the operation of the circuit of FIG. 1 according to the invention.

DESCRIPTION OF THE INVENTION

Figure 4:
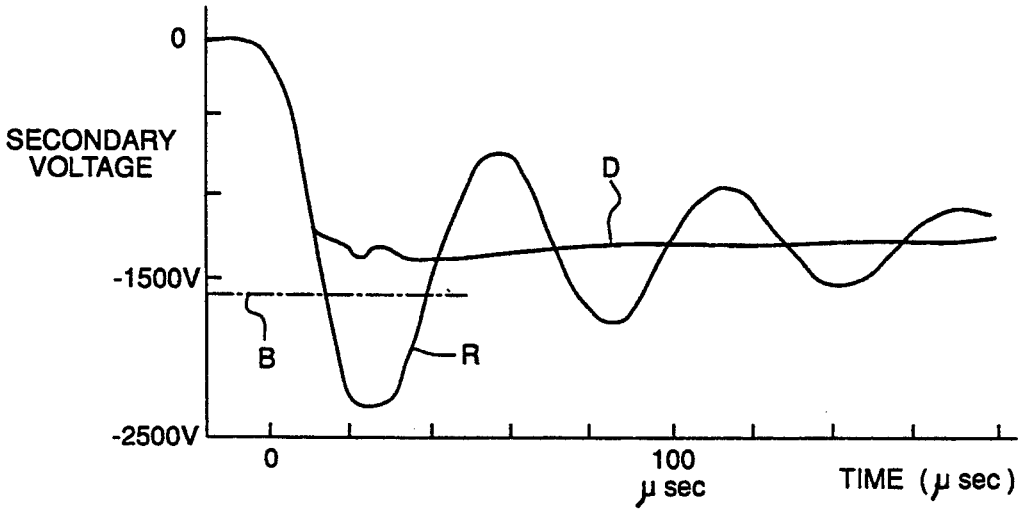
FIG. 4 is an illustration of secondary voltage curves for operation of the circuit of FIG. 1 conventionally and according to the invention.

The drawings and the ensuing description treat the secondary voltage as being negative during the dwell period and positive during the spark. The polarity is somewhat arbitrary and many engineers prefer the opposite sense. The operation is the same in any case.

Referring to FIG. 1, an inductive ignition circuit comprises an ignition coil 10 having a primary winding 12 serially coupled to an automotive battery 14 and a transistor switch 16 shown as an insulated gate bipolar transistor. Other switches may be used, although it is important that the switch be lossy, that is, energy is absorbed in the switch as it is being turned off. The gate 18 of the transistor receives the spark command pulse to turn the switch 16 on or off. The ignition coil also has a secondary winding 20 connected across a spark plug gap 22. An equivalent circuit for the coil turn-on condition is shown in FIG. 2 wherein the ignition coil 10 is replaced by an ideal transformer 24, and secondary impedances are reflected to the primary side and combined with primary impedances to result in resistance R and leakage inductance L in series with the battery and the transformer primary, and a capacitance C across the primary.

The application of an ordinary dwell command to the gate 18 of the transistor 16 would initiate a primary current causing an energy buildup in the leakage inductance L which would oscillate with the capacitance C, causing the undesired ringing which appears in the secondary circuit as a high voltage. FIG. 3*a* shows such a single dwell pulse which may extend for, say, 3 msec. The resulting secondary voltage is shown in FIG. 3*b*; the secondary voltage rapidly goes negative, rings for several cycles and gradually decays toward a zero value. At the end of the dwell pulse the secondary voltage jumps to a high voltage above a threshold A to discharge the spark plug. However, the ringing at dwell initiation exceeds a similar negative threshold B to cause plug discharge there. The same ringing event is shown more clearly as curve R in FIG. 4. The gap breakdown occurs, for example, at about 1550 volts, which is threshold B, and in this example the secondary voltage R exceeds 2400 volts. Also note, for this example, the ringing has an oscillation period of about 60 msec. For contrast, FIG. 4 also shows a curve D which is the secondary voltage without ringing achieved by the pulse control method disclosed herein.

Figure 6A:
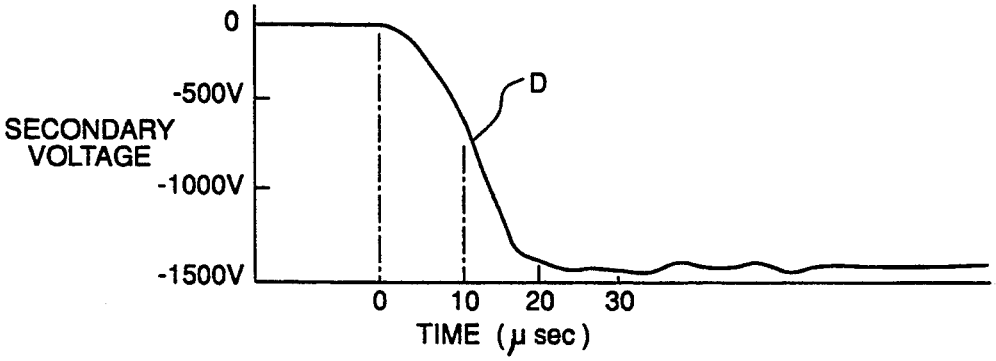
FIGS. 6*a*, 6*b*, and 6*c* are diagrams of secondary voltage, gate voltage and primary current for the operation of the circuit of FIG. 1 according to the invention.
Figure 6B:
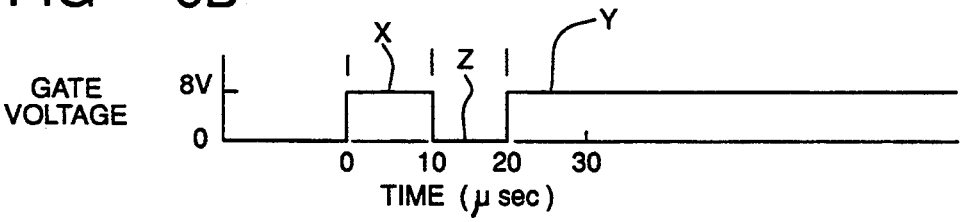
Figure 6C:
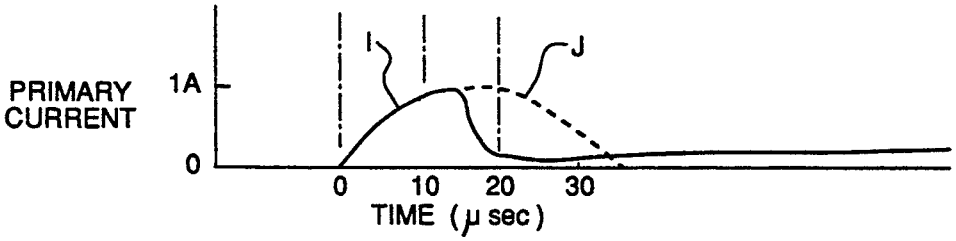

The control method applies a short pulse X and a long pulse Y to the transistor gate as indicated in FIG. 5*b* and in FIG. 6*b*. An off time Z separates the pulses X and Y. FIGS. 5*a* and 6*a* show the secondary voltage curve D which results from the control method, and FIG. 6*c* shows the primary current. While the optimum period for the initial pulse X and the off time Z are best determined empirically for each specific application, developmental experience shows that period X is on the order of 10 msec and the off period Z is about the same. It is also noted that the period X is always less than one fourth of the oscillation period when ringing is allowed. While the ringing can be fully avoided by the correct choice of the X and Y periods, the ringing can be greatly diminished and premature firing avoided when the periods are only approximately correct.

The rationale of the method is determined by examination of the FIGS. 6*a*, 6*b* and 6*c*. The current pulse curve I in FIG. 6*c* is accompanied by a dashed line portion J which indicates the primary current which occurs with the conventional single dwell pulse. The pulse X initiates the flow of primary current but truncates the current pulse by turning off when the ringing energy is all stored in the coil's leakage inductance, and the transistor then absorbs energy during switching. Even though the transistor gate voltage is removed, conduction continues in the inductive circuit for a short time at a high switch resistance to dissipate energy.

It will be appreciated that the principle mechanism at work is to somehow absorb the ringing energy before oscillation can take place. While other techniques for accomplishing this may be advanced, the preferred way is to command a dwell period, wait until the ringing energy is stored in the leakage inductance of the ignition coil, and then absorb the energy in the transistor switch by turning off the switch when the ringing energy is stored in the leakage inductance.

The embodiments of the invention in which an exclusive property or privilege is claimed are defined as follows:

1. In an inductive ignition circuit for an internal combustion engine having a primary winding and a transistor switch in series across a supply voltage and a secondary winding connected across a spark plug, wherein the secondary voltage is subject to ringing when the transistor switch is first turned on to prematurely fire the spark plug, a method of operating the ignition circuit and suppressing ringing of the secondary voltage comprising the steps of:

commanding a transistor switch turn on for a brief on time to begin a dwell period, whereby the secondary voltage begins to increase and primary current increases;

dissipating energy in the circuit by commanding a transistor switch turn off after the brief on time to reduce the primary current; and After a brief off time, turning on the transistor switch to complete the dwell period whereby the secondary voltage increases to a value insufficient to fire the spark plug while the transistor switch is on.

2. The invention as defined in claim 1 wherein the step of turning on the transistor switch to complete the dwell time occurs when the primary current is substantially reduced.

3. The invention as defined in claim 1 wherein the commanded brief on time is on the order of 10 microseconds.

4. The invention as defined in claim 1 wherein the commanded brief on and off times are each on the order of 10 microseconds.

5. The invention as defined in claim 1 wherein the ringing defines a resonance period, and the commanded brief on time is less than one fourth of a resonance period.

6. The invention as defined in claim 1 wherein the ringing defines a resonance period, and the brief off time is less than one fourth of a resonance period.

7. The invention as defined in claim 1 wherein the ignition circuit has leakage inductance; and the step of commanding transistor switch turn off occurs when ringing energy is substantially all stored in the leakage inductance.

8. The invention as defined in claim 1 wherein the ignition circuit has leakage inductance; and the step of turning on the transistor switch to complete the dwell time occurs when energy stored in the leakage inductance is substantially dissipated.

9. In an inductive ignition circuit for an internal combustion engine having a primary winding and a transistor switch in series across a supply voltage and a secondary winding connected across a spark plug, the transistor switch being controlled by a gate voltage, wherein the secondary voltage is subject to ringing when the transistor switch is first turned on to prematurely fire the spark plug, a method of operating the ignition circuit and suppressing ringing of the secondary voltage comprising the steps of:

initially operating the switch to increase secondary voltage and primary current, and then to dissipate energy in the transistor switch; and when the energy stored in the circuit is reduced sufficiently to suppress ringing, operating the transistor switch to complete the dwell period.

10. The invention as defined in claim 9 wherein:

the step of initially operating the switch comprises:

applying a brief gate voltage pulse to turn on the transistor switch to begin a dwell period, whereby the secondary voltage begins to increase and primary current increases; and terminating the gate voltage pulse to dissipate energy in the transistor switch by primary current flow during switching, whereby primary current is reduced; and the step of operating the transistor switch to complete the dwell period comprises reapplying the gate voltage to the switch.

11. The invention as defined in claim 9 wherein the step of reapplying the gate voltage to the transistor switch to complete the dwell time occurs when the primary current is substantially reduced.

12. The invention as defined in claim 10 wherein the duration of the brief gate voltage pulse is on the order of 10 microseconds.

13. The invention as defined in claim 10 wherein the gate voltage is reapplied to the transistor switch about 10 microseconds after the gate voltage pulse is terminated.

14. The invention as defined in claim 10 wherein the ringing defines a resonance period, and the duration of the gate voltage pulse is less than one fourth of a resonance period.

15. In an inductive ignition circuit for an internal combustion engine having a primary winding and a transistor switch in series across a supply voltage and a secondary winding connected across a spark plug, wherein the circuit has leakage inductance and the secondary voltage is subject to ringing when the transistor switch is first turned on and ringing energy is stored in the leakage inductance, a method of suppressing ringing of the secondary voltage comprising the steps of:

initiating a dwell period whereby the secondary voltage begins to increase and ringing energy becomes stored in the leakage inductance; and when substantially all the ringing energy is stored in the leakage inductance, dissipating the ringing energy.

16. The invention as defined in claim 15 wherein the dissipating step comprises:

waiting until substantially all the ringing energy is stored in the leakage inductance;

and then absorbing the ringing energy.

17. The invention as defined in claim 15 wherein the dissipating step comprises:

waiting until substantially all the ringing energy is stored in the leakage inductance;

and then turning off the switch long enough to absorb the ringing energy.

* * * * *